US005681192A

United States Patent [19]

Kobayashi et al.

[11] Patent Number: 5,681,192

[45] Date of Patent: Oct. 28, 1997

[54] MALE TERMINAL METAL FIXTURE

[75] Inventors: Masaaki Kobayashi; Hajime Okada, both of Yokkaichi, Japan

[73] Assignee: Sumitomo Wiring Systems, Ltd., Japan

[21] Appl. No.: 495,182

[22] Filed: Jun. 27, 1995

[30] Foreign Application Priority Data

Jul. 20, 1994 [JP] Japan ..... 6-190971

[51] Int. Cl.[6] ..... H01R 13/04

[52] U.S. Cl. ..... 439/884

[58] Field of Search ..... 439/884

[56] References Cited

U.S. PATENT DOCUMENTS

| | | | |
|---|---|---|---|
| 2,511,806 | 6/1950 | Macy | 439/884 |
| 3,134,632 | 5/1964 | Kimbal et al. | 439/884 |
| 4,992,064 | 2/1991 | Steinhardt et al. | 439/884 |

FOREIGN PATENT DOCUMENTS

| | | |
|---|---|---|
| 60-37819 | 11/1985 | Japan . |
| 89/07846 | 8/1989 | WIPO . |

*Primary Examiner*—Neil Abrams

*Attorney, Agent, or Firm*—Jordan B. Bierman; Bierman, Muserlian and Lucas LLP

[57] ABSTRACT

A male terminal metal fixture having a tab with a standard thickness is disclosed which is of high quality, although the fixture comprises a thin mother metal plate. The metal fixture is provided with a tab portion (6) which is folded so that each of longitudinal side edges is opposed to each other. The tab portion (6) is provided with an outwardly bulged area with a certain width (7) on the rear side along the opposed longitudinal side edges by means of a bulged process simultaneously with a bending process. Thus, the tab portion (6) can obtain a standard thickness. Moreover, the tab portion (6) is provided with an inward support projection (8) on the outwardly bulged area. The projection (8) prevents the tab portion (6) from being deformed at a hollow space defined by folded side edges (9) and the bulged area (7). Accordingly, it is possible to reduce a weight and a production cost of the male terminal metal fixture and to maintain the metal fixture to be of high quality.

4 Claims, 3 Drawing Sheets

MALE TERMINAL METAL FIXTURE

BACKGROUND OF THE INVENTION (1) Field of the Invention

This invention relates to a male terminal metal fixture which is secured to an end of an electrical cable.

(2) Statement of the Prior Art

For convenience of explanation, a conventional male terminal metal fixture will be described below by referring to FIGS. 7 and 8.

FIG. 7 is a partially broken-away side elevational view of a conventional male terminal metal fixture. FIG. 8 is a cross sectional view of the fixture taken along line VIII—VIII in FIG. 7. A general structure of such a male terminal metal fixture includes a barrel portion (a) adapted to clamp an end of an electrical cable and a tab portion (b) which is connected to a distal end of the barrel portion (a) and is adapted to contact with a female terminal metal fixture (not shown). The barrel and tab portions (a and b) are formed together by bending a mother metal plate.

The tab portion (b) must have standard width and thickness, since the tab portion (b) is inserted into and clamped by a mating female terminal metal fixture (not shown) to effect an electrical connection. On the other hand, it is better to use a relatively narrow mother metal plate so long as a necessary strength of the tab portion is assured, in view of the convenience of process.

Heretofore, the tab portion (b) is folded so that the longitudinal side edges are opposed to each other to obtain a desired thickness.

However, although the tab portion (b) is folded, it is, in some cases, necessary to use a thick mother metal plate to obtain a standard thickness.

For example, in the case that a standard thickness of the tab portion is designed to be 0.64 mm and a mother metal plate with a thickness of 0.25 mm will give a sufficient strength to the tab portion, a thickness of a folded tab portion will become 0.25×2=0.50 mm. This thickness does not satisfy the standard thickness. Consequently, it is compelled to use a mother metal plate with a thickness of 0.30 mm or 0.32 mm. This results in an increase in weight and cost.

On the other hand, there has been proposed a technique for forming a bulged area in the folded tab portion by pressing a mother metal plate with a small thickness to obtain a standard thickness of the tab portion. However, in this case, since a hollow space is formed in the folded tab portion, the folded side edges of the tab portion incline to be deformed inwardly in the tab portion by any external force. Further, it is difficult to maintain the tab portion with a constant quality on account of a strength of a mother metal plate.

SUMMARY OF THE INVENTION

An object of the present invention is to provide a male terminal metal fixture which can reduce the weight and cost and maintain a constant quality.

In order to achieve the above object, a male terminal metal fixture in accordance with the present invention includes a barrel portion adapted to clamp an electrical cable and a tab portion adapted to contact with a female terminal. Both portions are integrally formed from a metal plate by means of a bending process. The tab portion is folded so that longitudinal side edges are opposed to each other. The tab portion is provided with an outwardly bulged area on the rear side along the opposed longitudinal side edges. The outwardly bulged area is provided with an inward support projection which contacts with the opposed longitudinal side edges.

The outwardly bulged area may extend to a coupling portion between the tab portion and the barrel portion.

Although the inward support projection may be provided on a center on the outwardly bulged area, a plurality of inward support projections may be provided on the area so long as an electrical contact between the tab portion and the female terminal metal fixture is not deteriorated.

According to the present invention, it is possible to form the tab portion into a standard thickness by means of a bulged process even though the mother metal plate is thin. Although the folded tab portion is likely bent inwardly by an external force since a bulged on the metal plate forms a hollow space in the folded tab portion, the inwardly bulged support projection can bear the tab portion against an inward deflection of the tab portion.

In the case of forming the outwardly bulged area on the tab portion, the tab portion itself must be reinforced but the coupling portion between the tab portion and the barrel portion becomes weak on account of the thin mother metal plate. However, extension of the bulged area to the coupling portion can reinforce it and make the mother metal plate thinner.

Provision of a plurality of inward support projections can bear the folded tab portion positively.

According to the present invention, it is possible to reduce the weight and cost of the metal fixture because the male terminal metal fixture can use a mother metal plate with a desired thickness and it is also possible to maintain the metal fixture at a high quality since the inward support projection or projections are provided on the outwardly bulged area.

DETAILED DESCRIPTION OF THE PREFERRED EMBODIMENTS

Referring now to FIGS. 1 to 6, embodiments of a male terminal metal fixture in accordance with the present invention will be described below.

<First Embodiment>

Figure 1:
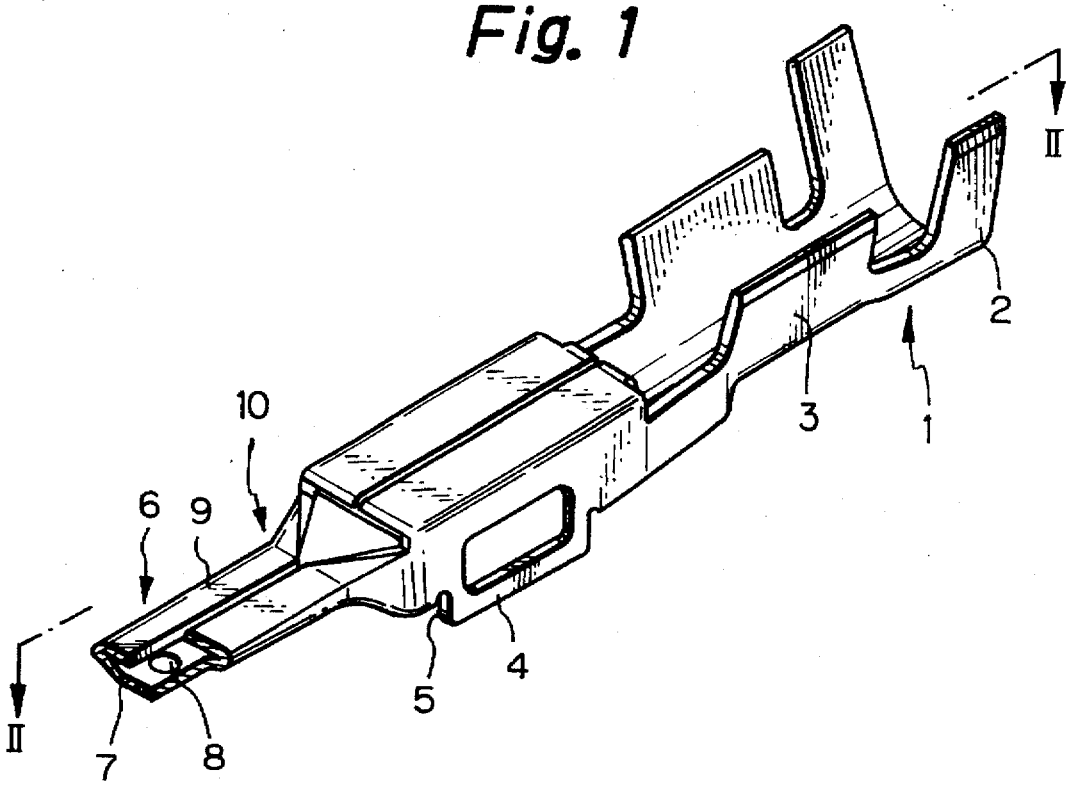
FIG. 1 is a partially broken-away perspective view of a first embodiment of a male terminal metal fixture of the present invention.
Figure 2:
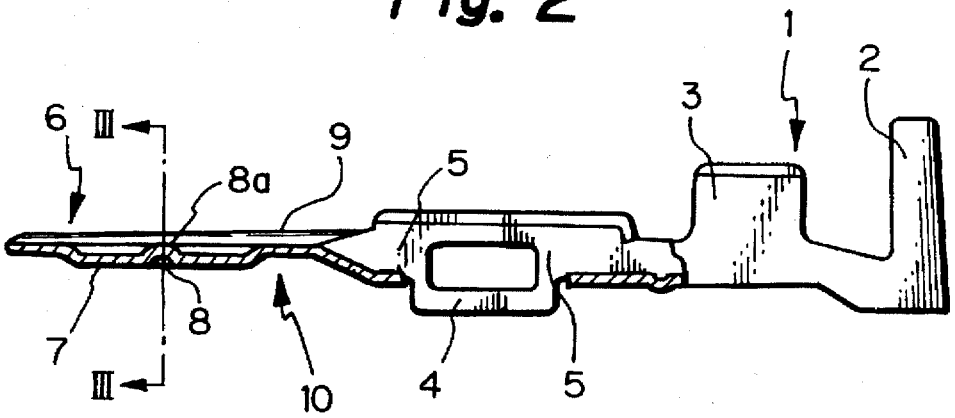
FIG. 2 is a longitudinal sectional view of the metal fixture taken along line II—II in FIG. 1.
Figure 3:
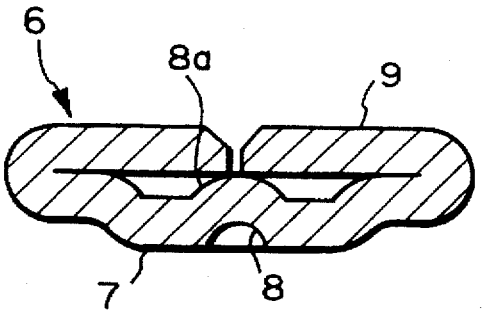
FIG. 3 is a cross sectional view taken along line III—III in FIG. 2.

FIGS. 1 to 3 show a first embodiment of the present invention. A male terminal metal fixture in the first embodiment is formed by bending a mother metal plate and includes a barrel portion 1, a pair of stabilizers 4, and a tab portion 6 in order from a rear end to a front end.

The barrel portion 1 is provided with an insulation barrel section 2 which has a pair of long legs and is adapted to be crimped on an insulation cover of an electrical cable (not shown) and with a wire barrel section 3 which has a pair of short legs spaced from the long legs and is adapted to be crimped on an exposed core wires of the electrical cable.

Each stabilizer projects in a direction opposite from the barrel sections 2 and 3 between openings 5 which receive a locking lance (not shown) provided in a connector housing in which the male terminal metal fixture is accommodated. Each stabilizer 4 is provided on its inner face with a bulged area adapted to clamp the lance fitted in the opening 5 when the male terminal metal fixture is accommodated in the connector housing.

The tab portion 6 is folded in a direction opposite from the stabilizers 4 so that the longitudinal side edges are opposed to each other, thereby forming the tab portion into a desired width. The tab portion 6 is provided on its distal end with tapered faces which enable the tab portion to be easily inserted into a mating female terminal metal fixture.

The tab portion 6 is also provided along a longitudinal center line on a flat section opposite to folded sections 9 with an outwardly bulged area 7 having a certain width by means of a press process simultaneously with a bending process of the tab portion 6. Thus, the tab portion 6 is formed into a standard thickness.

Moreover, the outwardly bulged area 7 is provided on its center with an inward support projection 8 by means of a press process. An apex 8*a* (FIG. 3) of the projection 8 contacts with longitudinal side edges of the folded sections 9 of the tab portion 6. Since the inward support projection 8 bears the folded sections 9, they are not deflected easily by an external force, although the outwardly bulged area 7 forms a hollow space in the tab portion 6.

According to the first embodiment of the present invention, it is possible to obtain a necessary thickness of the tab portion in spite of using a thin mother metal plate, thereby decreasing the weight and cost of the male terminal metal fixture. Further, it is possible to maintain high quality of the metal fixture, since the inward support projection 8 can prevent the folded sections 9 of the tab portion 6 from being deflected in the hollow space in the tab portion.

<Second Embodiment>

In the case of forming the outwardly bulged area 7 on the tab portion 6 in the first embodiment, a coupling or neck portion 10 between the tab portion 6 and the stabilizers 4 becomes weak, thereby limiting reduction of thickness of the portion 10.

Figure 4:
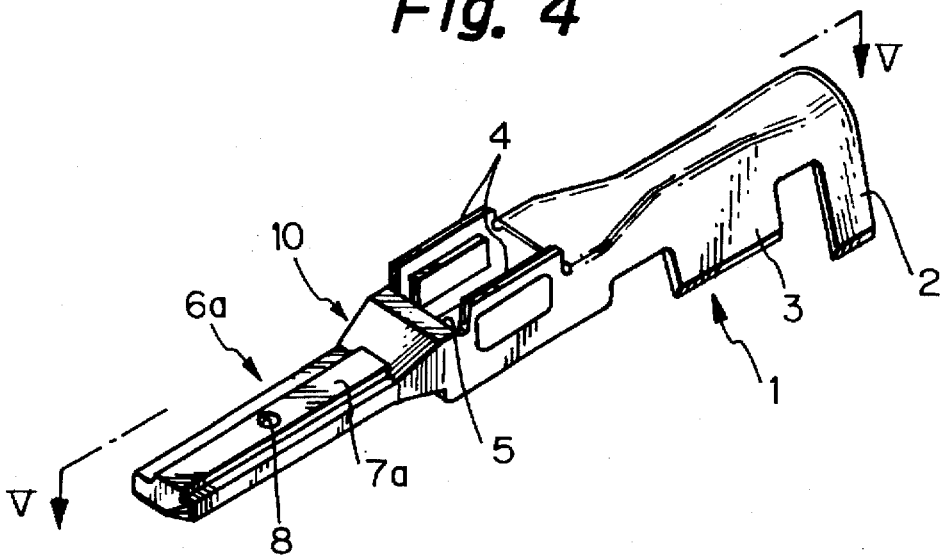
FIG. 4 is a perspective view of a second embodiment of the male terminal metal fixture of the present invention.
Figure 5:
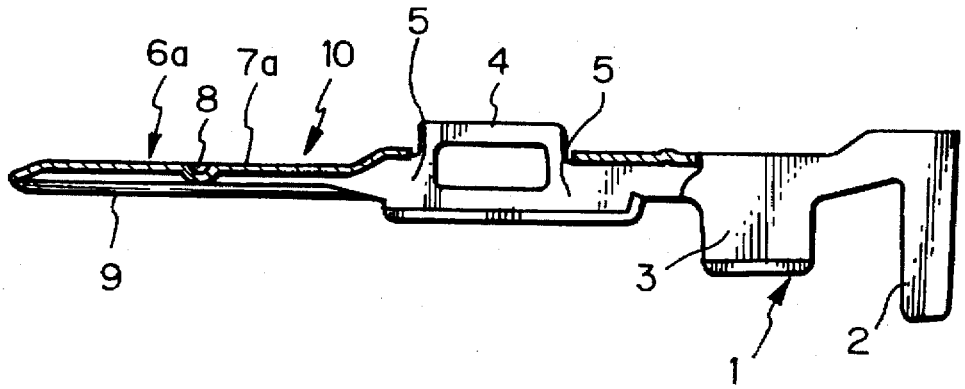
FIG. 5 is a longitudinal sectional view of the metal fixture taken along line V—V in FIG. 4.

Thus, in a second embodiment shown in FIGS. 4 and 5, an outwardly bulged area 7*a* extends from a front end of a tab portion 6*a* to the coupling portion 10.

This enhances a bending stiffness in the coupling portion 10 of the tab portion 6*a* and achieves a reduction in thickness of the portion 6*a*.

The other portions are the same as those of the first embodiment. In FIGS. 4 and 5, a barrel portion 1 includes an insulation barrel section 2, a wire barrel section 3, openings 5 adapted to receive a lance, and an inward support projection 8 to bear folded sections 9.

<Third Embodiment>

Figure 6A:
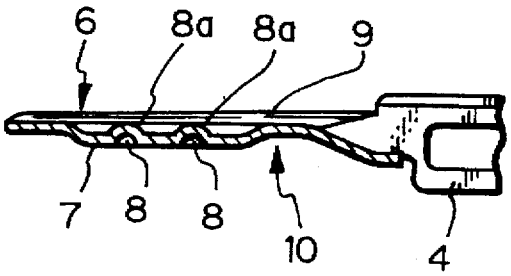
FIGS. 6A and 6B are longitudinal sectional view of a third embodiment of a tab portion of the metal fixture of the present invention.
Figure 6B:
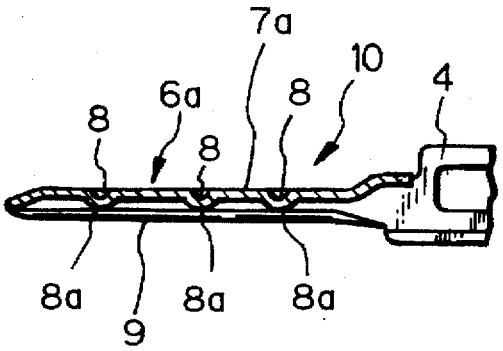
Figure 7:
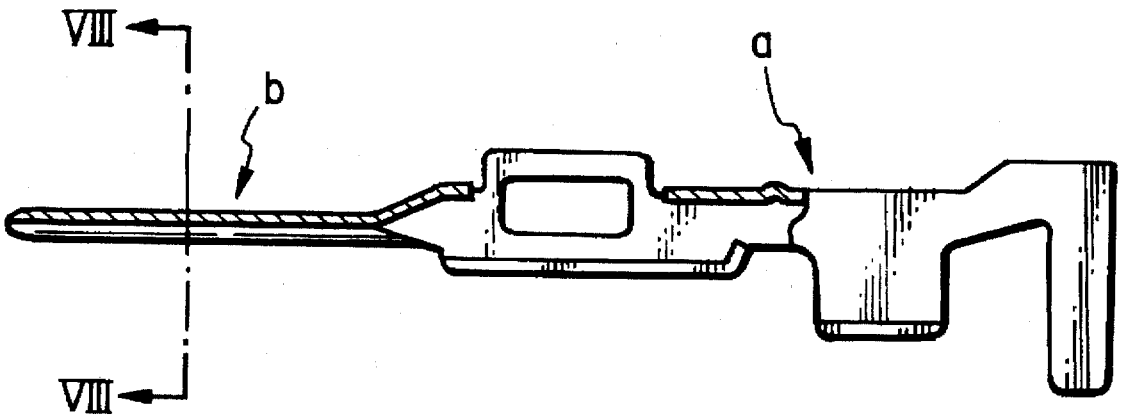
Fig. 7 PRIOR ART
FIG. 7 is a partially broken-away longitudinal sectional view of a conventional male terminal metal fixture.
Figure 8:
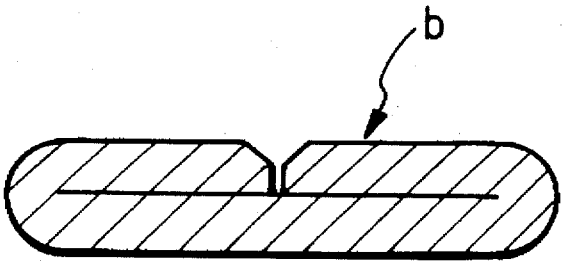
Fig. 8 PRIOR ART
FIG. 8 is a cross sectional view of the metal fixture taken along line VIII—VIII in FIG. 7.

Although the inward support projections 8 and apexes 8*a* provided on the center of the bulged areas 7 and 7*a* in the first and second embodiments, a plurality of inward support projections 8 may be provided on the outwardly bulged area 7 as shown in FIGS. 6A and 6B so long as the projections 8 do not lower an electrical contact between the tab portion 6 and the female terminal metal fixture when the portion 6 is inserted into the female fixture. The tab portion 6 shown in FIG. 6A corresponds to the tab portion 6 in the first embodiment while the tab portion shown in FIG. 6B corresponds to the tab portion 6*a* in the second embodiment. The other portions are the same as those in the first and second embodiments.

Provision of a plurality of inward support projections can positively bear the folded sections of the tab portion.

It should be noted that the present invention is not limited to the above embodiments. The present invention may be altered as follows. Although the stabilizers 4 project in the direction opposite from the barrel portion 1 between the openings 5 in the above embodiments, the stabilizers may projects in the same direction as the barrel portion or may be omitted.

What is claimed is:

1. A male terminal metal fixture having a barrel portion, adapted to be crimped on an electrical cable, and a tab portion, adapted to electrically contact a female terminal, said tab portion being folded so that longitudinal side edges thereof are adjacent and opposed to each other on a front side of said tab portion, a rear side of said tab portion, opposite to said front side and constituting a plane, said rear side having a laterally centrally located bulged area extending longitudinally of said tab portion and bulging outwardly of said plane, said bulged area having at least one inwardly extending support projection in contact with a rear face of said front side.

2. A male terminal metal fixture according to claim 1, wherein said outwardly bulged area extends to a coupling portion between said tab portion and said barrel portion.

3. A male terminal metal fixture according to claim 2, wherein said outwardly bulged area is provided with a plurality of inward support projections.

4. A male terminal metal fixture according to claim 1, wherein said outwardly bulged area is provided with a plurality of inward support projections.

* * * * *